US007832458B2

(12) United States Patent
Aliyev et al.

(10) Patent No.: US 7,832,458 B2
(45) Date of Patent: Nov. 16, 2010

(54) METHOD FOR PRODUCING A CASTING MOLD FROM A COMPOSITE MOLD MATERIAL FOR FOUNDRY PURPOSES

(75) Inventors: Rezo Aliyev, Freiberg (DE); Detlev Gantner, Freiberg (DE)

(73) Assignee: ACTech GmbH, Freiberg (DE)

( * ) Notice: Subject to any disclaimer, the term of this patent is extended or adjusted under 35 U.S.C. 154(b) by 931 days.

(21) Appl. No.: 11/217,219

(22) Filed: Sep. 1, 2005

(65) Prior Publication Data

US 2007/0044932 A1 Mar. 1, 2007

(51) Int. Cl.
*B22C 9/00* (2006.01)
*B22C 9/08* (2006.01)

(52) U.S. Cl. ..... 164/17; 164/23; 164/529

(58) Field of Classification Search ..... 164/17, 164/23, 161–162, 229, 456, 520–529
See application file for complete search history.

(56) References Cited

U.S. PATENT DOCUMENTS

| | | | | |
|---|---|---|---|---|
| 4,104,347 | A | 8/1978 | Ohashi et al. | |
| 6,564,852 | B1 | 5/2003 | Wendt et al. | |
| 6,666,254 | B2 | 12/2003 | Voigt et al. | |
| 2001/0040017 | A1 * | 11/2001 | Gustafson | 164/17 |
| 2004/0055725 | A1 | 3/2004 | Ray et al. | |
| 2005/0016706 | A1 | 1/2005 | Ray et al. | |

FOREIGN PATENT DOCUMENTS

| | | |
|---|---|---|
| DE | 196 52 223 A1 | 6/1998 |
| DE | 100 14 591.4 | 8/2001 |
| DE | 100 14 744 | 10/2001 |
| FR | 1 138 883 | 11/1955 |
| JP | 61245942 | 11/1986 |
| JP | 1215770 | 8/1989 |

OTHER PUBLICATIONS

Ambos, E., "Pattern Engineering of Metallic Materials", Verlag für Grundstoffindustrie, 2nd Edition, Leipzig 1982, p. 51.

* cited by examiner

*Primary Examiner*—Kuang Lin
(74) *Attorney, Agent, or Firm*—Collard & Roe, P.C.

(57) ABSTRACT

A method for producing a casting mold from a composite mold material for foundry purposes that is composed of different kinds of mold materials that are heat-resistant for the casting of metals and that differ in substantive composition or have different contents of organic or inorganic binders. A solid mold body is prepared from a foundry mold material A that is completely or partially encased during its preparation with a free-flowing chemically bonded foundry mold material B. A composite mold material block is formed after the hardening of the foundry mold material B, which is then machined by a cutting method such as milling, boring, turning, or grinding. The mold cavity is introduced into the mold body consisting of the foundry mold material A, and the inflow system and the feed system are introduced into the mold material block consisting of the foundry mold material B, using CAD data.

7 Claims, 3 Drawing Sheets

METHOD FOR PRODUCING A CASTING MOLD FROM A COMPOSITE MOLD MATERIAL FOR FOUNDRY PURPOSES

BACKGROUND OF THE INVENTION

1. Field of the Invention

The invention relates to a method for producing a casting mold from a composite mold material for foundry purposes, that is composed of various types of mold materials that are heat-resistant for casting metals and that have a differing substantive composition or a differing content of organic or inorganic binders. Such mold materials in particular are combinations of heat-resistant molding compositions and core compositions that consist of a refractory inorganic base material, usually quartz sand, and a binder system. For special demands on the mold and on the casting, refractory ceramic compositions and materials are also used that can be machined by cutting production processes. Because of its desirable price, its abundance, and its properties, quartz sand is the predominant mold base material.

2. The Prior Art

It has long been known in practice, in the search for economical methods in the production of casting molds, how to use mold materials with different properties and accordingly of various compositions. According to Ambos, Urformtechnik metallischer Werkstoffe [Pattern Engineering of Metallic Materials], Verlag für Grundstoffindustrie, 2nd Edition, Leipzig 1982, page 51, it is customary in the manual and mechanized production of molds and cores, whenever these exceed a given minimum size, to apply a thin layer of heavy-duty mold material to the pattern or to the core box wall. This mold material comes into direct contact with the liquid metal during the casting and must have properties adequate for the casting. Therefore, it contains a relatively high proportion of binder and is called a pattern mold material.

Most of the mold box or core box, however, is filled with a mold material of lower quality, the so-called filling mold material or filling sand. It contains substantially less binder and provides corresponding cost reductions compared with filling the entire mold with heavy-duty mold material like that needed at the contact surface of the mold material with the liquid metal. It is a drawback that a pattern is needed for producing a casting mold. The production of a pattern is associated with a further cost increase and a considerable expenditure of time. The method is also restricted to the production of casting molds that consist exclusively of foundry mold sand.

Japanese Patent No. JP 61 245 942 A1 discloses a method for producing a lost-wax casting mold made of a composite mold material that has a plaster mold embedded in a sand mold. To make the plaster mold and the sand mold, a pattern has to be prepared each time. For the plaster mold, a wax pattern is made that is placed in a container and a plaster slurry is poured over it. The plaster mold is subjected to primary and secondary calcinations so that the ceramic mold is hardened. The plaster mold is embedded in the casting mold with foundry mold sand and the liquid metal is then poured in. Various time-consuming production steps are necessary with this method to produce the pattern for the sand mold and the plaster mold, which are associated with substantial costs. For this reason the proposed method is not suitable in particular for the fast production of prototypes.

Economical and fast prototypes increasingly approximating design studies and functional purposes are needed in product development in order to reduce high development costs. The fast availability of prototypes is not provided for because of the necessary production of patterns, because the production of ceramic casting molds requires a lot of time.

SUMMARY OF THE INVENTION

It is therefore an object of the invention to provide a fast and economical method for the production of a casting mold from a composite mold material for foundry purposes that is composed of different types of mold-materials.

The invention achieves the above objective by producing a block-like composite mold material from differing foundry mold materials and then machining it mechanically. In the production of the block-like composite mold material, a solid mold body is first produced from the foundry mold material A, usually parallelepiped in shape, which is encased by a powdered and free-flowing foundry mold material B, usually chemically bonded mold sand, which is bonded to the foundry mold material A after hardening and participates in a form fit connection. The form-fitting embedment of the ceramic mold body in the foundry sand can be accomplished with the help of projections or recesses, or by an appropriate prismatic shape of the ceramic mold body with conically tapered sidewalls.

The negative contour of the casting is introduced into the foundry mold material A during the subsequent machining, while only the inflow system and the feed system are introduced into the foundry mold material B. In accordance with the different material data, it is desirable for the machining of the mold cavity for the casting to use a separate CAD/CAM machining program in the region of the foundry mold material A. Accordingly, a second machining program for a cutting method, preferably a milling program for the direct milling of the mold material, can be used for the machining of the inflow system and of the feed system in the region of the foundry mold material B.

The advantage of the proposed method is a casting mold of a composite mold material consisting of two different foundry mold materials that has a substantive composition differing according to the desired casting quality. The differing substantive composition can be characterized by differing contents of binder or by the composition of the foundry mold material used. A composite material combining conventional foundry sand for the foundry mold material B with ceramic materials for the foundry mold material A is especially advantageous. The ceramic material in this case exclusively contains the casting geometry.

The production of qualitatively high-grade castings with regard to dimensional accuracy and surface quality with a ceramic casting mold can be substantially simplified and made faster because the proportion of ceramic to be machined can be reduced to a minimum.

BRIEF DESCRIPTION OF THE DRAWINGS

Other objects and features of the present invention will become apparent from the following detailed description considered in connection with the accompanying drawings. It is to be understood, however, that the drawings are designed as an illustration only and not as a definition of the limits of the invention.

In the drawings, wherein similar reference characters denote similar elements throughout the several views.

DETAILED DESCRIPTION OF THE PREFERRED EMBODIMENT

Figure 1:
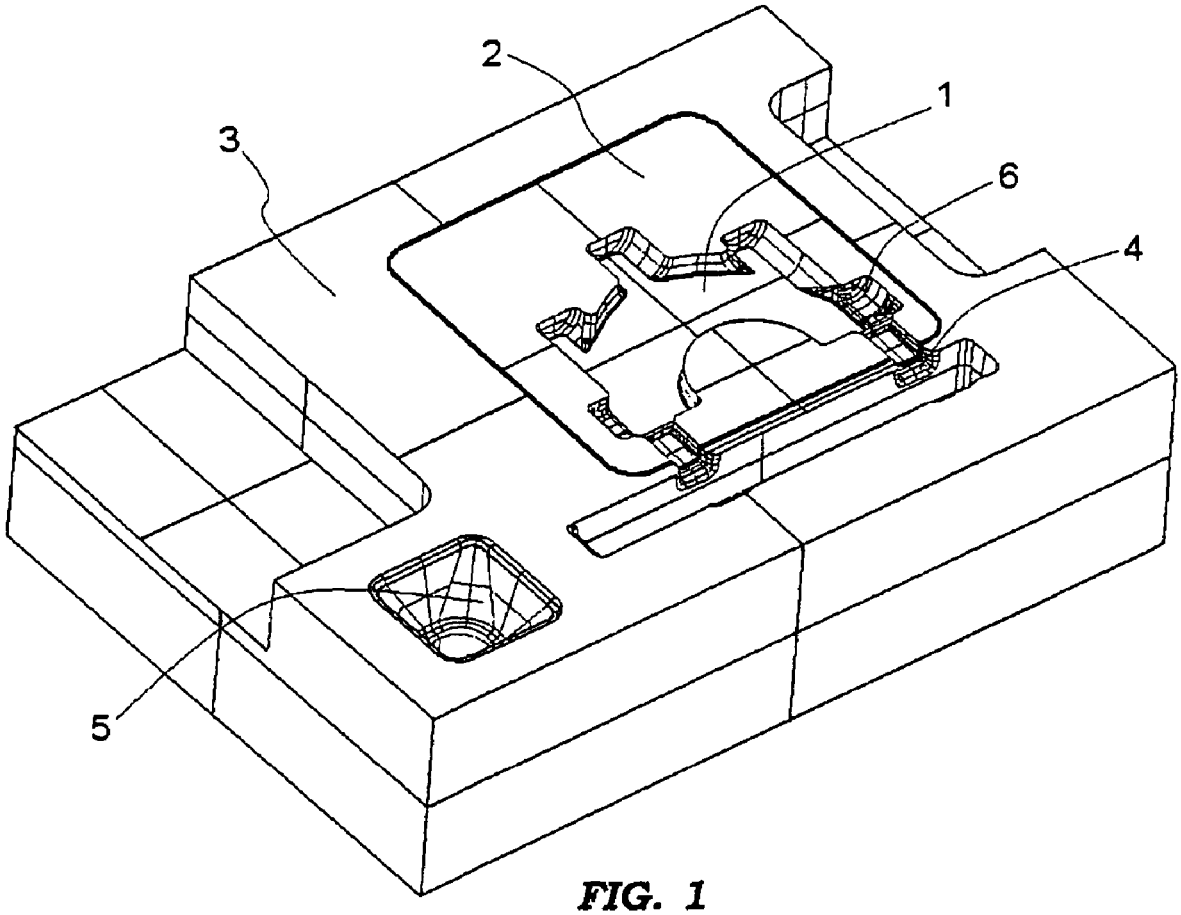
FIG. 1 shows half of a casting mold consisting of two foundry mold materials according to an embodiment of the invention.

The example of embodiment below will be described with reference to a ceramic casting mold for a casting, for example a precision casting. FIG. 1 shows one half of a casting mold that in combination with the counterpart (not shown) forms a casting mold for a metallic casting. The mold cavity 1 of the casting in this case is modeled by a mold body 2 that is made completely of a ceramic foundry mold material A. The mold body 2 with a mold material block 3 made of a foundry mold material B constitutes a block-like composite mold material. A portion of the inflow system 4 and of the feed system 5 is visible in the region of the mold material block 3 consisting of the foundry mold material B. The casting mold is a two-part mold, for example with an upper part and a lower part. In case of more complex castings, the casting mold can consist of multiple parts, for example of cores also. Core marks 6 can be incorporated into the casting mold halves with no problems for the insertion of cores.

Figure 2:
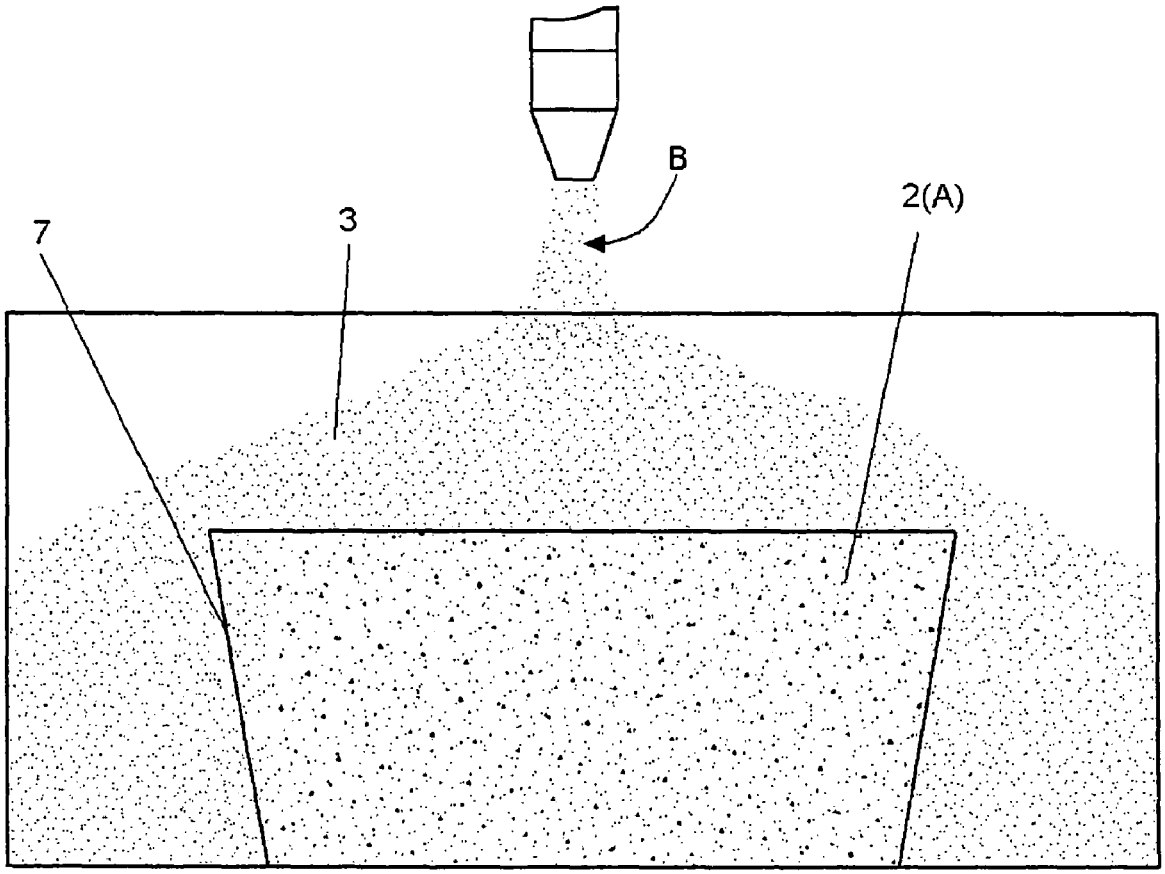
FIG. 2 shows the production of a block-like composite mold material from two different foundry mold materials.

In the example according to FIG. 2 for the stepwise preparation of a casting mold, one of the particular halves of the casting mold is made of appropriate composite mold material that contains a mold body 2 made of a ceramic foundry mold material A. A prismatic mold body 2 is first produced from the ceramic foundry mold material A that conforms essentially to the dimensions of the actual casting without the inflow system 4 and the feed system 5. The ceramic mold body 2 is produced at final strength using a foundry mold material A that is suitable for cutting by a method such as milling, boring, turning, grinding, or eroding, and that meets the casting specifications with regard to heat resistance and resistance to reaction with the casting material.

In the next operating step, before producing the mold cavity 1 for the casting, the ceramic mold body 2 consisting of the foundry mold material A is encased in a powdered and free-flowing chemically bonded foundry mold material B, with which the mold material block 3 is formed. The inflow system 4 and the feed system 5 are essentially integrated into the mold material block 3. The mold body 2 should be joined with a form fit to the encasing chemically hardening foundry mold material B during the block shaping of the mold material block 3. The form fit can be accomplished with the assistance of projections or recesses or by an appropriate prismatic shape of the mold body 2 with conically tapered sidewalls 7. It is preferred to use a foundry mold sand consisting of quartz sand with a thermosetting binder for encasing the ceramic mold body 2. The casting mold is thereupon heated during the block molding with the introduced foundry sand-binder mixture at a temperature above the melting point of the binder, and the mold material block 3 is hardened. After hardening, the mold body 2 consisting of the foundry mold material A together with the mold material block 3 consisting of the foundry mold material B constitutes a composite mold material that can be machined in a chuck by a cutting method with an appropriate machine tool, by milling, boring, turning, or grinding.

However, the invention is not to be limited to a foundry mold material B with a thermosetting binder. Instead, it is within the scope of the patent claims to use bentonites as binders for foundry mold sand. As examples, waterglass or furan resins, as well as other products of organic chemistry, can be used as hardening binders. Cement can be used with good success as a hardening binder for larger castings. A foundry mold material that has plaster added as binder can also be used. Overall, binders can be used that allow subsequent machining of the casting system by cutting methods.

Figure 3:
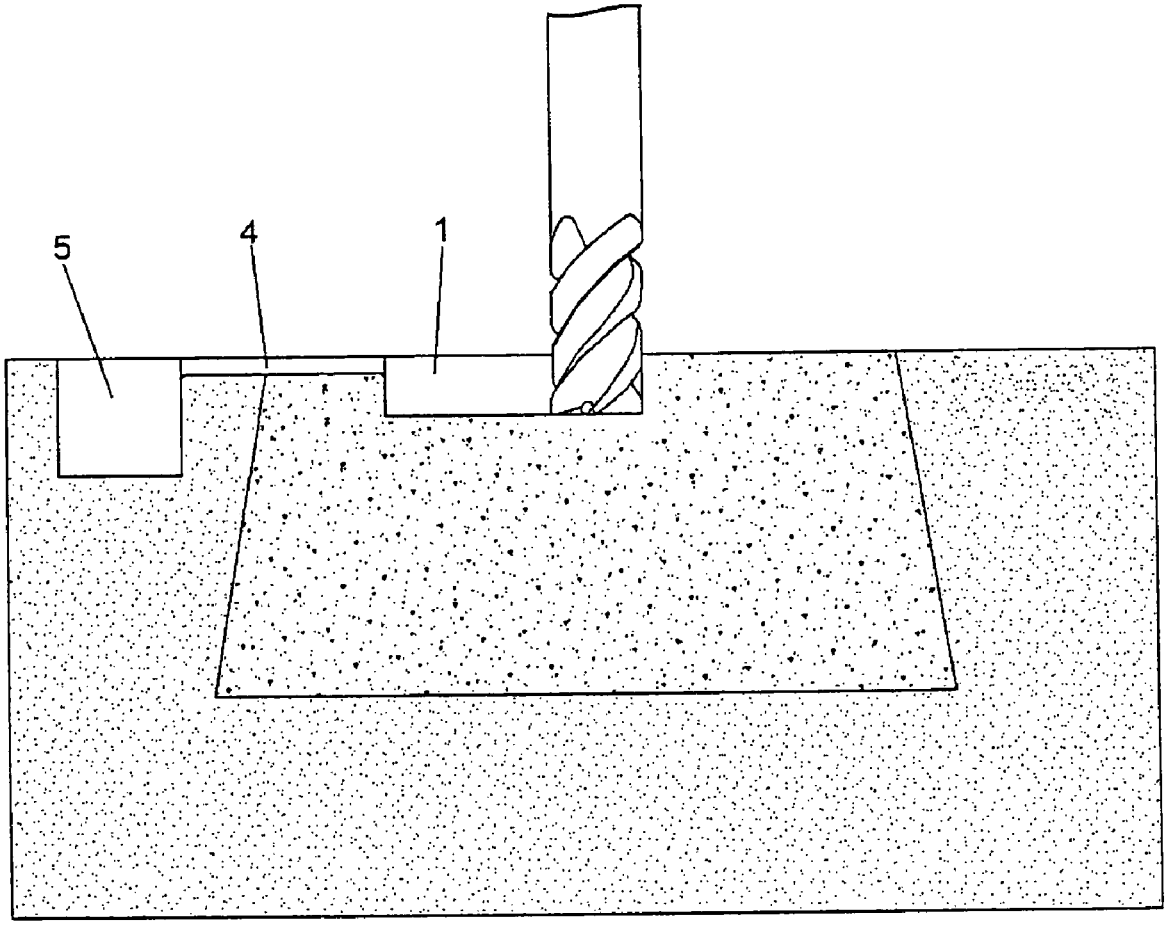
FIG. 3 shows the introduction of the mold contour by milling, in schematic illustration.

According to FIG. 3, the inflow system 4 and the feed system 5 can be machined in a further operating step, which can be accomplished especially advantageously when using foundry mold sand by direct milling of mold material by a CNC milling machine. The mold cavity 1 for the casting is likewise produced with a CNC machine tool.

CAM systems are used for the NC programming of complicated three-dimensional surfaces, which makes manual programming unnecessary. The development work in the preparation of prototypes is reduced to the dimensionally accurate designing in a CAD system. Such systems are independent of the complexity of the casting and make possible different machining instructions for milling strategies and other cutting methods. The production of prototypes is thus based directly on the 3D datasets of the unmachined casting from which the datasets for the mold cavity 1 are generated. Thus, a still faster and economical exclusively computer-assisted preparation of prototypes is possible by using the direct milling of mold material.

The cavity for the inflow system 4 and the feed system 5 is designed from the data for the unmachined casting from which the datasets for the inflow system 4 and the feed system 5 are prepared. The milling program is set up using the tool parameters by a data transfer with NC data derived from it. It is advantageous that it is possible to use a special milling strategy for producing the inflow system 4 and the feed system 5 when using a synthetic resin-bonded foundry mold sand.

A foundry mold material A that is optimal for the mold body 2 can be chosen, while the foundry mold material B simplifies the mechanical machining or better satisfies other boundary conditions. Consequently, the most favorable milling strategy can be selected separately in each case for the mold cavity 1, the inflow system 4, and the feed system 5.

This method can also be used for castings with complicated geometry. In this way, the invention enables the production of faster prototypes.

Accordingly, while only a few embodiments of the present invention have been shown and described, it is obvious that many changes and modifications may be made thereunto without departing from the spirit and scope of the invention.

What is claimed is:

1. A method for producing a casting mold from a composite mold material for foundry purposes that is composed of different kinds of mold materials that are heat-resistant for the casting of metals and that differ in substantive composition or have different contents of organic or inorganic binders, the method comprising the following steps:

forming a hard molded body comprised of a block of a solid mold material A;

encasing the molded body with a free-flowing chemically bonded foundry mold material B;

hardening mold material B to form a block-shaped composite mold material block consisting of said block of said solid mold material A and said hardened mold material B;

machining said block-shaped composite mold material block after said step of hardening, with a cutting method selected from milling, boring, turning, or grinding, using CAD data, to introduce a mold cavity into the molded body formed from mold material A, and to introduce an inflow system and a feed system into a part of the mold material block consisting of the foundry mold material B, using CAD data.

2. The method pursuant to claim 1, wherein said mold material A consists of refractory ceramic foundry mold materials resistant to temperature changes.

3. The method pursuant to claim 1, wherein mold material A consists of a foundry mold sand with a thermosetting binder or a binder based on bentonites, waterglass, furan resin, cement, or plaster, with the binder content or variety of sand differing from that in foundry mold material B.

4. The method pursuant to claim 1, wherein said mold material B consists of foundry mold sand with a thermosetting binder or a binder based on bentonites, waterglass, furan resin, cement, or plaster.

5. The method pursuant to claim 1, wherein the mold body is bonded with a form fit to the foundry mold material B during the forming of the block, by means of projections or recesses, or by a prismatic shape with conically tapered sidewalls.

6. The method pursuant to claim 1, wherein the mold cavity is machined with an NC program generated from 3D datasets of an unmachined casting, and wherein the inflow system and the feed system are produced with a separate NC program, with matched machining parameters in each case.

7. The method pursuant to claim 1, further comprising the step of incorporating core prints for cores into the casting mold.

* * * * *